US010822980B2

(12) United States Patent
Banks et al.

(10) Patent No.: US 10,822,980 B2
(45) Date of Patent: Nov. 3, 2020

(54) GAS TURBINE ENGINE STRESS ISOLATION SCALLOP

(71) Applicant: United Technologies Corporation, Hartford, CT (US)

(72) Inventors: Anton G. Banks, Manchester, CT (US); Anthony P. Cherolis, Hartford, CT (US); Donald Kastel, Hamden, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 854 days.

(21) Appl. No.: 14/783,054

(22) PCT Filed: Apr. 11, 2014

(86) PCT No.: PCT/US2014/033770
§ 371 (c)(1),
(2) Date: Oct. 7, 2015

(87) PCT Pub. No.: WO2014/169193
PCT Pub. Date: Oct. 16, 2014

(65) Prior Publication Data

US 2016/0047259 A1 Feb. 18, 2016

Related U.S. Application Data

(60) Provisional application No. 61/810,930, filed on Apr. 11, 2013, provisional application No. 61/810,964, (Continued)

(51) Int. Cl.
*F01D 11/00* (2006.01)
*F01D 9/04* (2006.01)
(Continued)

(52) U.S. Cl.
CPC ..... *F01D 11/005* (2013.01); *F01D 9/02* (2013.01); *F01D 9/04* (2013.01); *F01D 9/041* (2013.01);
(Continued)

(58) Field of Classification Search
CPC . F01D 11/005; F01D 9/02; F01D 9/04; F01D 9/041; F01D 9/047; F01D 11/00;
(Continued)

(56) References Cited

U.S. PATENT DOCUMENTS 3,781,125 A 12/1973 Rahaim
4,017,213 A 4/1977 Przirembel
(Continued)

FOREIGN PATENT DOCUMENTS

GB 2462268 2/2010

OTHER PUBLICATIONS

EP search report for EP14782209.2 dated May 6, 2016.
(Continued)

*Primary Examiner* — Aaron R Eastman
(74) *Attorney, Agent, or Firm* — Getz Balich LLC

(57) ABSTRACT

A nozzle segment for a gas turbine engine includes an arcuate outer vane platform segment. An arcuate inner vane platform segment spaced from the arcuate outer vane platform segment. A multiple of airfoils between the arcuate inner vane platform segment and the arcuate outer vane platform segment, the arcuate outer vane platform segment includes a scallop slot and a seal that seals the scallop slot.

7 Claims, 23 Drawing Sheets

Related U.S. Application Data filed on Apr. 11, 2013, provisional application No. 61/810,976, filed on Apr. 11, 2013, provisional application No. 61/810,982, filed on Apr. 11, 2013.

(51) Int. Cl.
*F01D 25/24* (2006.01)
*F01D 9/02* (2006.01)

(52) U.S. Cl.
CPC ..... *F01D 9/047* (2013.01); *F01D 11/00* (2013.01); *F01D 11/003* (2013.01); *F01D 25/24* (2013.01); *F01D 25/246* (2013.01); *F05D 2220/32* (2013.01); *F05D 2240/128* (2013.01); *F05D 2240/55* (2013.01); *F05D 2240/57* (2013.01); *F05D 2240/59* (2013.01); *F05D 2260/20* (2013.01); *F05D 2260/97* (2013.01)

(58) Field of Classification Search
CPC ..... F01D 11/003; F01D 25/24; F01D 25/246; F05D 2220/32; F05D 2240/128; F05D 2240/55; F05D 2240/57; F05D 2240/59; F05D 2260/20; F05D 2260/97
USPC ..... 415/209.4
See application file for complete search history.

(56) References Cited

U.S. PATENT DOCUMENTS 4,749,333 A 6/1988 Bonner et al.
4,820,119 A 4/1989 Joyce
5,114,159 A 5/1992 Baird et al.
5,271,714 A * 12/1993 Shepherd ..... F01D 25/246 415/189
6,254,333 B1 7/2001 Merry
6,447,255 B1 * 9/2002 Bagnall ..... F01D 5/066 277/626
6,672,584 B2 1/2004 Silverbrook
6,792,763 B2 9/2004 Sileo et al.
6,834,507 B2 12/2004 Jorgensen
7,178,340 B2 2/2007 Jorgensen
7,229,245 B2 * 6/2007 Ellis ..... F01D 9/041 415/135
7,293,957 B2 11/2007 Ellis et al.
7,360,769 B2 4/2008 Bennett
7,540,709 B1 6/2009 Ebert
2003/0091427 A1 * 5/2003 Powis ..... F01D 5/189 415/1
2003/0113201 A1 * 6/2003 Powis ..... F01D 5/189 415/1
2004/0120814 A1 * 6/2004 Brainch ..... F01D 9/041 415/209.3
2004/0156719 A1 8/2004 Czachor
2005/0186074 A1 8/2005 Tomita et al.
2006/0013685 A1 1/2006 Ellis et al.
2007/0141368 A1 * 6/2007 Farmer ..... F01D 5/288 428/469
2007/0154305 A1 7/2007 Amess et al.
2007/0166154 A1 * 7/2007 Ellis ..... F01D 9/041 415/211.2
2007/0237624 A1 * 10/2007 Nigmatulin ..... F01D 11/005 415/115
2009/0016873 A1 1/2009 Bridges, Jr. et al.
2009/0074562 A1 3/2009 Self et al.
2009/0274562 A1 * 11/2009 Minor ..... F01D 5/288 416/241 R
2011/0020118 A1 * 1/2011 Smoke ..... F01D 9/02 415/191
2011/0179798 A1 * 7/2011 Pieussergues ..... F01D 9/023 60/752
2012/0195743 A1 * 8/2012 Walunj ..... F01D 11/006 415/174.5
2013/0004314 A1 1/2013 Alvanos et al.
2013/0256990 A1 * 10/2013 Zheng ..... F16J 15/0887 277/312

OTHER PUBLICATIONS

EP Office Action for EP Application No. 14 782 209.2—1006 dated Oct. 15, 2018.
Office action for EP14782209.2 dated Nov. 4, 2019.

* cited by examiner

GAS TURBINE ENGINE STRESS ISOLATION SCALLOP

The present application claims priority to PCT Patent Appln. No. PCT/US14/033770 filed Apr. 11, 2014, which is entitled to the benefit of and incorporates by reference essential subject matter disclosed in U.S. Provisional Patent Application Ser. No. 61/810,930, filed Apr. 11, 2013, and 61/810,964, filed Apr. 11, 2013, and 61/810,976, filed Apr. 11, 2013, and 61/810,982 filed Apr. 11, 2013.

BACKGROUND OF THE INVENTION

1. Technical Field

The present disclosure relates to a gas turbine engine and, more particularly, to a nozzle ring for a gas turbine engine.

2. Background Information

Gas turbine engines, such as those that power modern commercial and military aircraft as well as industrial gas turbine engine, generally include a compressor to pressurize an airflow, a combustor to burn a hydrocarbon fuel in the presence of the pressurized air, and a turbine to extract energy from the resultant combustion gases.

The turbine section often includes one or more stages with annular nozzle rings adjacent to each turbine blade row to define axially alternate annular arrays of stator vanes and rotor blades. The annular nozzle rings are subjected to substantial aerodynamic and thermal loads.

SUMMARY

A nozzle segment for a gas turbine engine according to one disclosed non-limiting embodiment of the present disclosure includes an arcuate outer vane platform segment. An arcuate inner vane platform segment is spaced from the arcuate outer vane platform segment. A multiple of airfoils are disposed between the arcuate inner vane platform segment and the arcuate outer vane platform segment. The arcuate outer vane platform segment includes a scallop slot and a seal that seals the scallop slot.

In a further embodiment of the present disclosure, the seal is a feather seal.

In a further embodiment of any of the foregoing embodiments of the present disclosure, the feather seal is received within a slot transverse to the scallop slot.

In a further embodiment of any of the foregoing embodiments of the present disclosure, the seal is a guillotine seal.

In a further embodiment of any of the foregoing embodiments of the present disclosure, the multiple of airfoils include turbine vanes.

In a further embodiment of any of the foregoing embodiments of the present disclosure, the scallop slot is located in an aft vane rail hook.

In a further embodiment of any of the foregoing embodiments of the present disclosure, the scallop slot partially interrupts a seal surface.

In a further embodiment of any of the foregoing embodiments of the present disclosure, the seal is a U-shaped clip seal.

In a further embodiment of any of the foregoing embodiments of the present disclosure, the clip seal is received on a wall transverse to the scallop slot.

In a further embodiment of any of the foregoing embodiments of the present disclosure, the seal is generally Ω-shaped.

In a further embodiment of any of the foregoing embodiments of the present disclosure, the seal includes a central portion between a first leg and a second leg.

In a further embodiment of any of the foregoing embodiments of the present disclosure, the central portion includes a flat that is generally flush with a seal surface.

In a further embodiment of any of the foregoing embodiments of the present disclosure, the seal is a spring pin.

In a further embodiment of any of the foregoing embodiments of the present disclosure, the spring pin is cylindrical.

In a further embodiment of any of the foregoing embodiments of the present disclosure, the spring pin includes a slot.

A gas turbine engine according to another disclosed non-limiting embodiment of the present disclosure includes an annular nozzle with a multiple of scallop slots and at least one seal that seals each of the multiple of scallop slots.

In a further embodiment of any of the foregoing embodiments of the present disclosure, the multiple of scallop slots are located in an arcuate outer vane platform segment.

In a further embodiment of any of the foregoing embodiments of the present disclosure, the multiple of scallop slots are located in an aft vane rail hook.

In a further embodiment of any of the foregoing embodiments of the present disclosure, the annular nozzle includes a multiple of airfoils.

In a further embodiment of any of the foregoing embodiments of the present disclosure, the annular nozzle includes a multiple of vanes.

In a further embodiment of any of the foregoing embodiments of the present disclosure, each seal is a feather seal.

In a further embodiment of any of the foregoing embodiments of the present disclosure, each seal is adjacent a W-seal surface.

In a further embodiment of any of the foregoing embodiments of the present disclosure, each seal is a clip seal.

A method to alleviate a compressive stress in nozzle segment of a gas turbine engine according to another disclosed non-limiting embodiment of the present disclosure includes locating a scallop cut in an arcuate outer vane platform segment; and sealing the scallop cut.

A further embodiment of any of the foregoing embodiments of the present disclosure includes sealing the scallop cut with a feather seal.

A further embodiment of any of the foregoing embodiments of the present disclosure includes locating the scallop cut in an aft vane rail hook of the arcuate outer vane platform segment.

A further embodiment of any of the foregoing embodiments of the present disclosure includes sealing the scallop cut with a clip seal.

A further embodiment of any of the foregoing embodiments of the present disclosure includes sealing the scallop cut with a Ω-shaped seal.

A further embodiment of any of the foregoing embodiments of the present disclosure includes locating a central portion between a first leg and a second leg of the Ω-shaped seal within the scallop cut.

A further embodiment of any of the foregoing embodiments of the present disclosure includes sealing the scallop cut with a spring pin.

A further embodiment of any of the foregoing embodiments of the present disclosure includes pressurizing the spring pin.

A further embodiment of any of the foregoing embodiments of the present disclosure includes locating the scallop cut in an aft vane rail hook of the arcuate outer vane platform segment.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
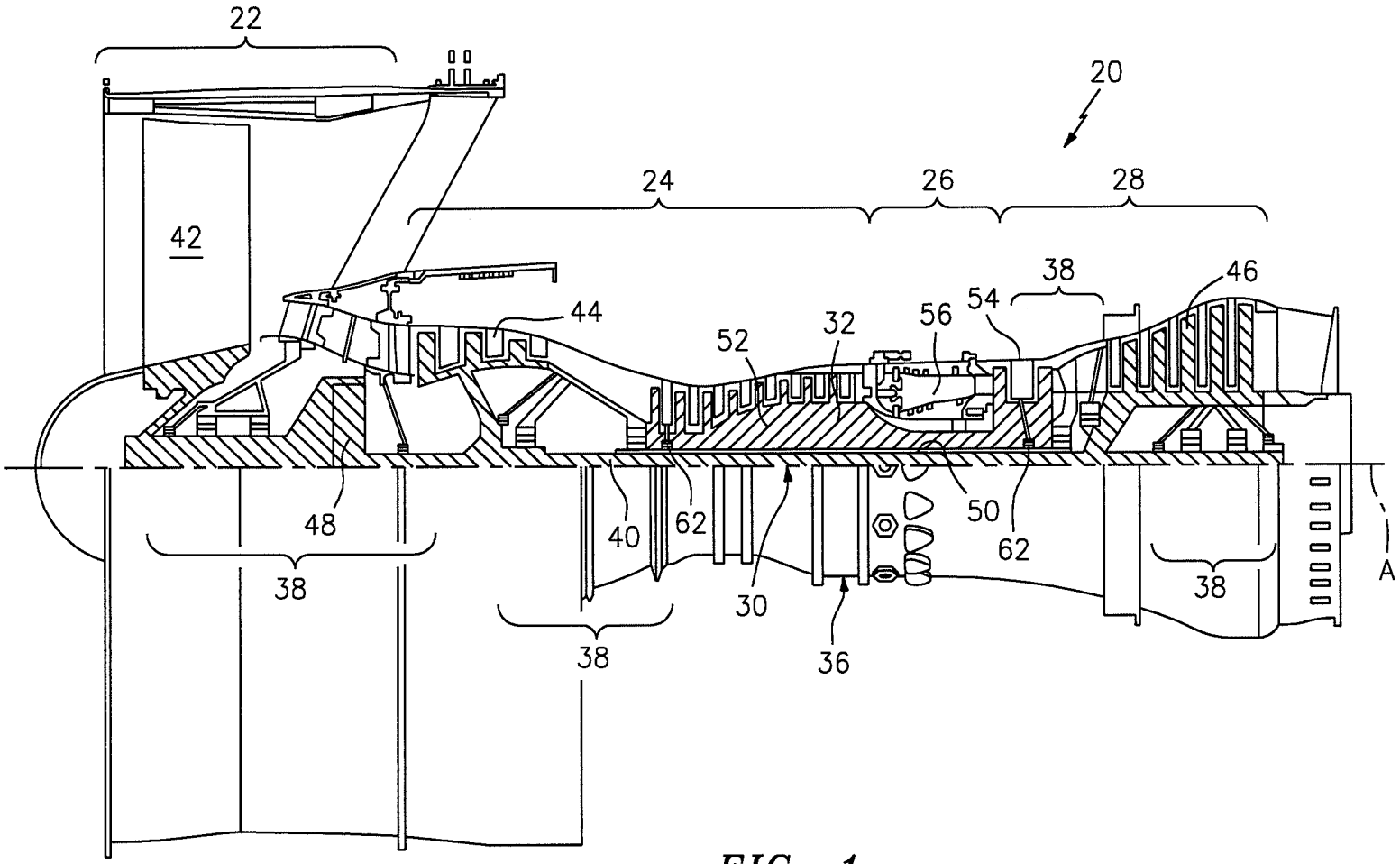
FIG. 1 is a schematic cross-section of one example aero gas turbine engine.
Figure 2:
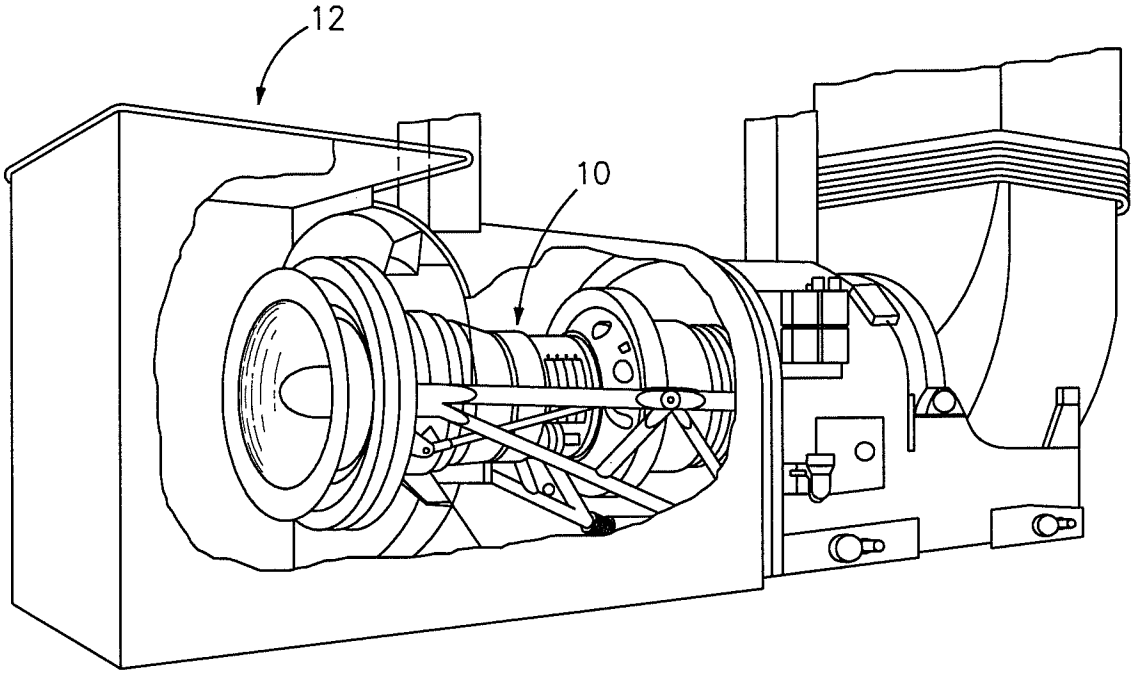
FIG. 2 is a schematic cross-section of one example Industrial gas turbine engine.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engines might include an augmentor section (not shown) among other systems or features as well as a gas turbine engine 10 within an enclosure 12 (illustrated schematically; FIG. 2) typical of an industrial gas turbine (IGT).

The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited to use with turbofans as the teachings may be applied to other types of turbine engines such as a turbojets, turboshafts, and three-spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low Pressure Turbine ("LPT").

The engine 20 generally includes a low spool 30 and a high spool 32 mounted for rotation about an engine central longitudinal axis "A" relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis "A" which is collinear with their longitudinal axes.

Core airflow is compressed by the LPC 44 then the HPC 52, mixed with the fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by bearing structures 38 within the static structure 36. It should be appreciated that various bearing structures 38 at various locations may alternatively or additionally be provided.

In one non-limiting example, the gas turbine engine 20 is a high-bypass geared aircraft engine. In a further example, the gas turbine engine 20 bypass ratio is greater than about six (6:1). The geared architecture 48 can include an epicyclic gear train, such as a planetary gear system or other gear system. The example epicyclic gear train has a gear reduction ratio of greater than about 2.3, and in another example is greater than about 2.5:1. The geared turbofan enables operation of the low spool at higher speeds which can increase the operational efficiency of the low pressure compressor 44 and low pressure turbine 46 and render increased pressure in a fewer number of stages.

A pressure ratio associated with the low pressure turbine 46 is pressure measured prior to the inlet of the low pressure turbine 46 as related to the pressure at the outlet of the low pressure turbine 46 prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 44, and the low pressure turbine 46 has a pressure ratio that is greater than about five (5:1). It should be appreciated, however, that the above parameters are only exemplary of one embodiment of a geared architecture engine and that the present disclosure is applicable to other gas turbine engines including direct drive turbofans.

In one embodiment, a significant amount of thrust is provided by the bypass flow path due to the high bypass ratio. The fan section 22 of the gas turbine engine 20 is designed for a particular flight condition—typically cruise at about 0.8 Mach and about 35,000 feet (10,668 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $(\text{“Tram”}/518.7)^{0.5}$. The Low Corrected Fan Tip Speed according to one non-limiting embodiment of the example gas turbine engine 20 is less than about 1150 fps (351 m/s).

Figure 3:
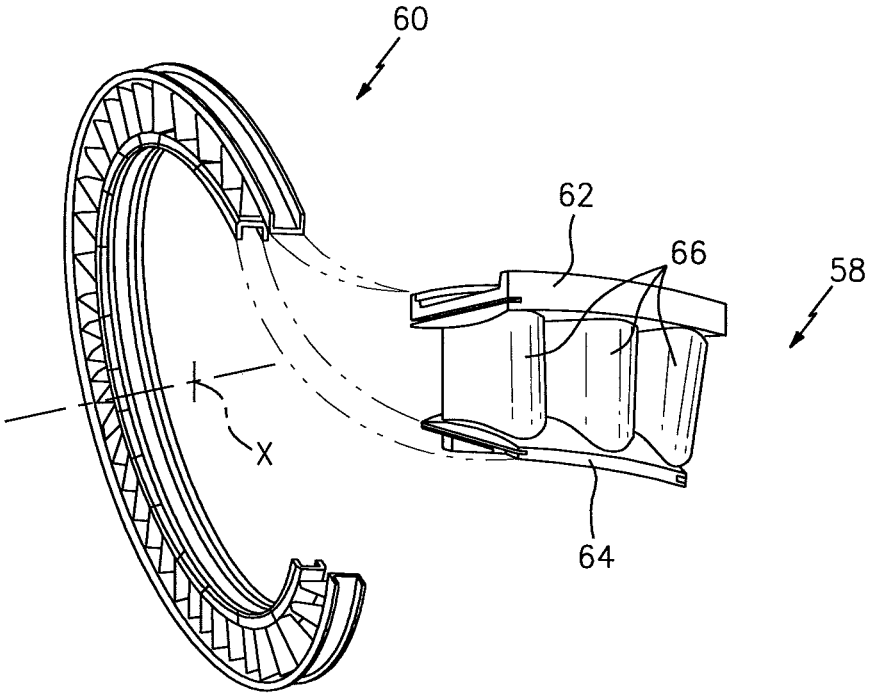
FIG. 3 is a partially exploded view of a nozzle segment of an annular nozzle.

With reference to FIG. 3, one stage of the LPT 46 includes a multiple of nozzle segments 58 that together form an annular nozzle 60. Each nozzle segment 58 generally includes an arcuate outer vane platform segment 62 and an arcuate inner vane platform segment 64 radially spaced apart from each other by a multiple of airfoils 66 (three shown). The temperature environment and the substantial aerodynamic and thermal loads are accommodated by the circumferentially adjoining nozzle segments 58 which collectively form the full, annular nozzle 60 about the centerline axis X of the engine.

Figure 4:
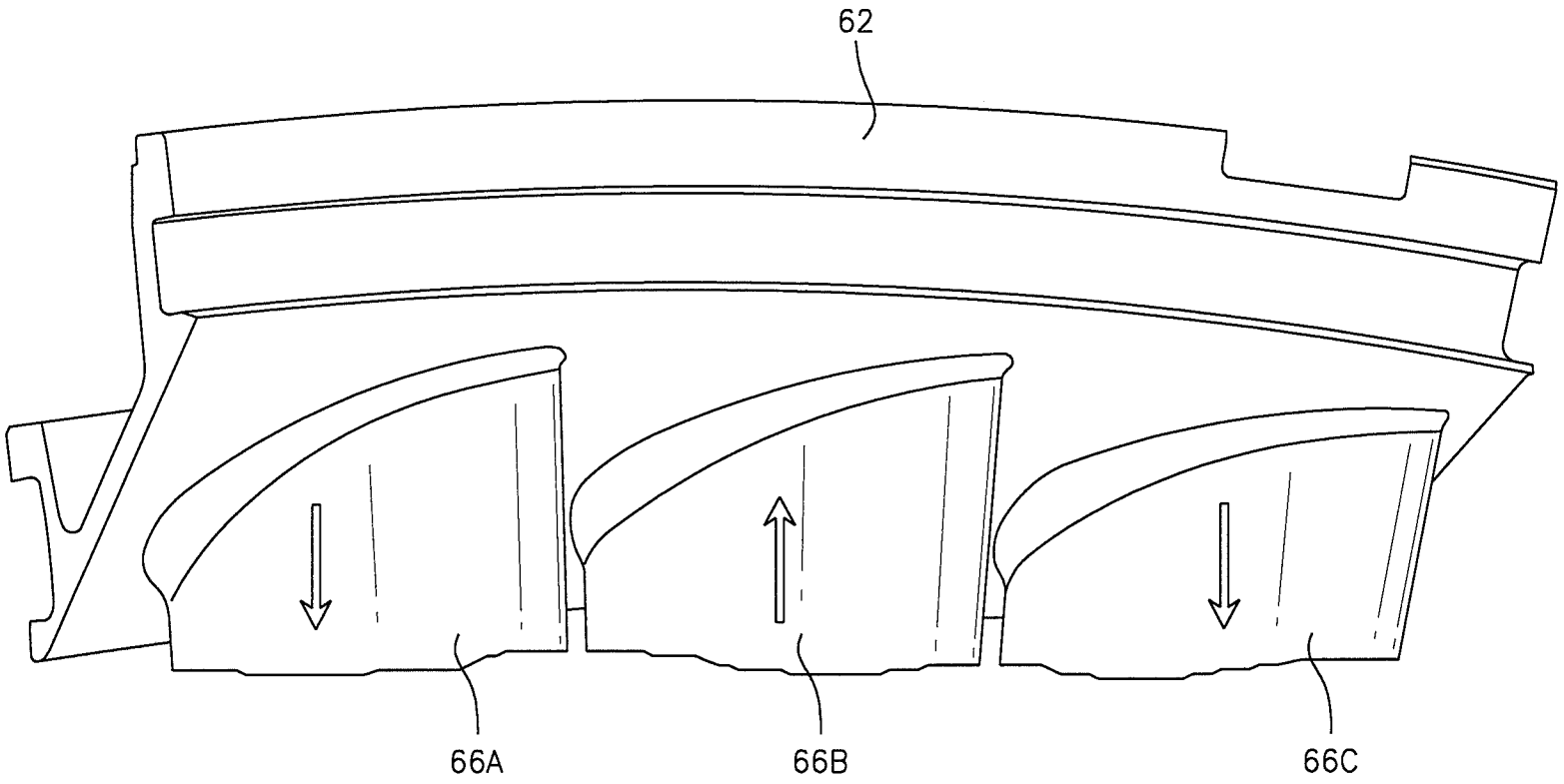
FIG. 4 is an expanded rear view of a nozzle segment illustrating a deflection thereof as a dotted line.

With reference to FIG. 4, due to the temperature environment, the outer vane platform segment 62 flattens out. This results in a load being applied to the three airfoils 66 in the triplet. This force is reacted out through the three airfoils 66A, 66B, and 66C as shown in which 66A and 66C are in tension (being pulled) while airfoil 66B is being compressed. With the airfoils 66A, 66C reacting against airfoil 66B, airfoil 66B may exhibit relatively high compressive stresses.

Figure 5:
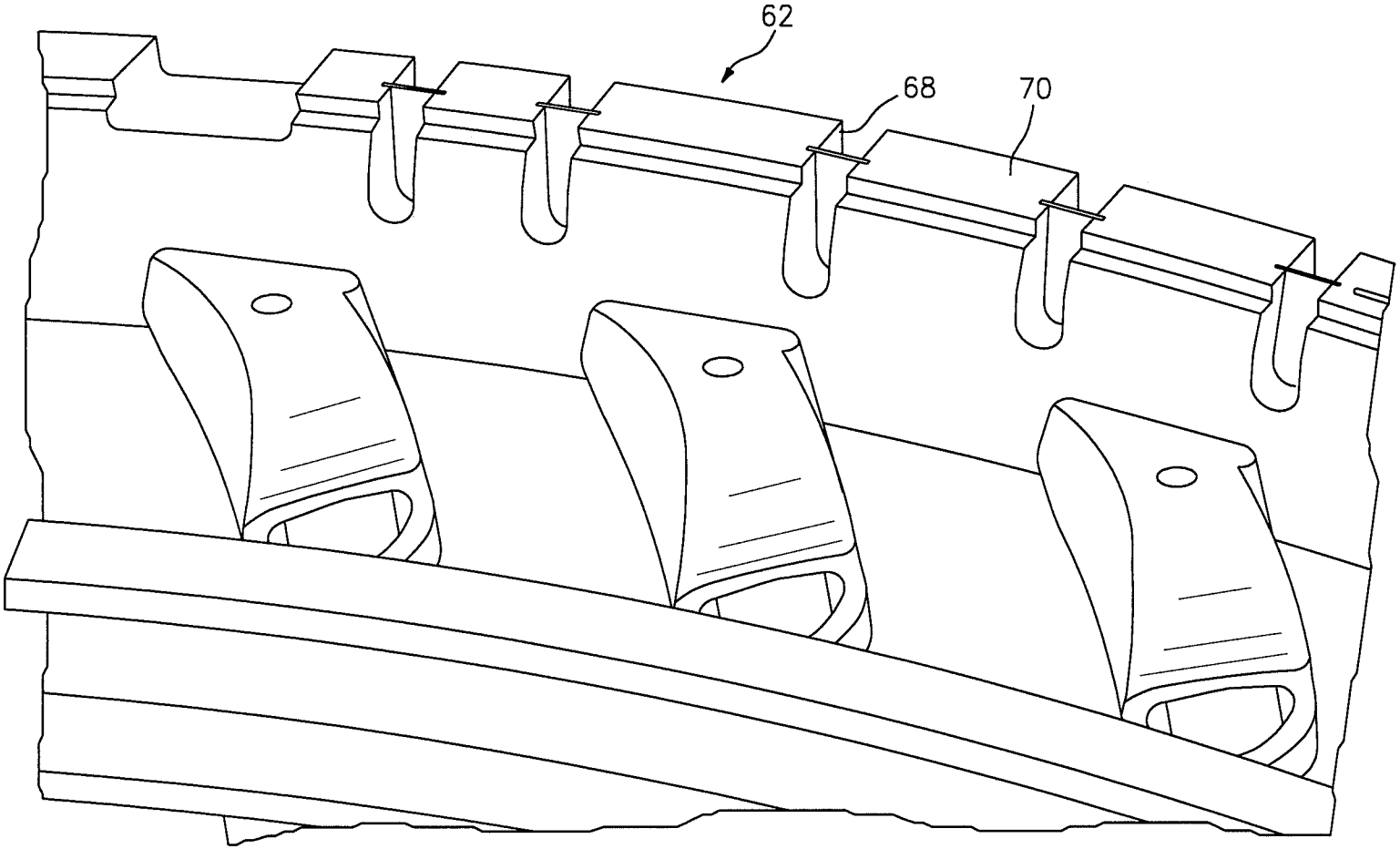
FIG. 5 is an expanded view looking aft toward an aft rail of a nozzle segment according to one disclosed non-limiting embodiment.
Figure 6:
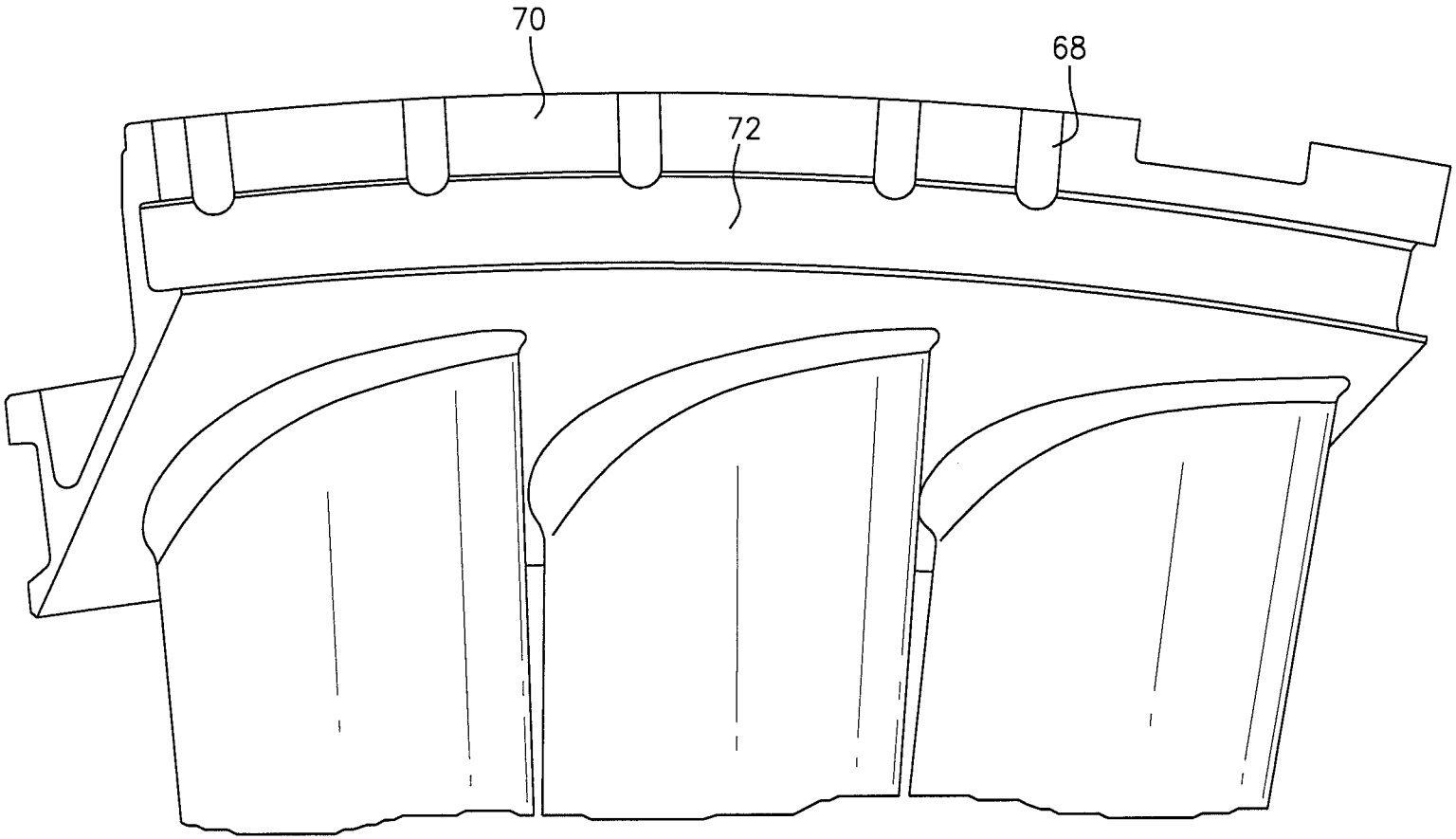
FIG. 6 is an expanded view looking forward toward an aft rail of a nozzle segment with a seal according to one disclosed non-limiting embodiment.
Figure 7:
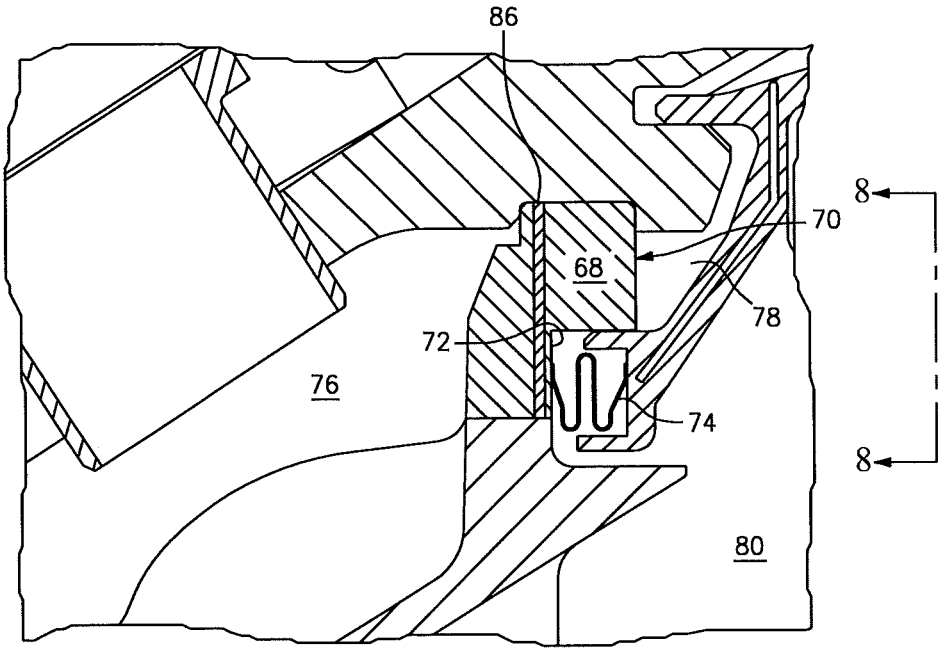
FIG. 7 is a sectional view of the nozzle segment.
Figure 8:
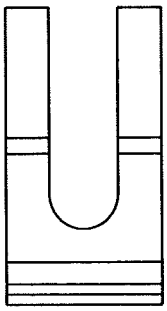
FIG. 8 is an expanded view from line 8-8 in FIG. 7.

With reference to FIG. 5, to alleviate the compressive stresses, a scallop cut 68 is located in the outer vane platform segment 62 to penult controlled bending. In one disclosed non-limiting embodiment, the scallop cut 68 may be located in an aft vane rail hook 70 and extends for a depth into a seal surface 72 (FIGS. 6, 7 and 8) but is not flush with the seal surface 72 that is in contact with a W-seal 74 (FIG. 7). It should be appreciated that various numbers, depths and locations may be provided for the scallop cuts 68. That is, the scallop cuts 68 may be located to specifically alleviate compressive stresses.

With reference to FIG. 7, the W-seal 74 seals to the seal surface 72 that is recessed with respect to the aft vane rail hook 70. The W-seal 74 seals airflow between a forward cavity 76 and an aft cavity 78. The W-seal 74 also seals airflow between a core airflow cavity 80 and the aft cavity 78.

Figure 9:
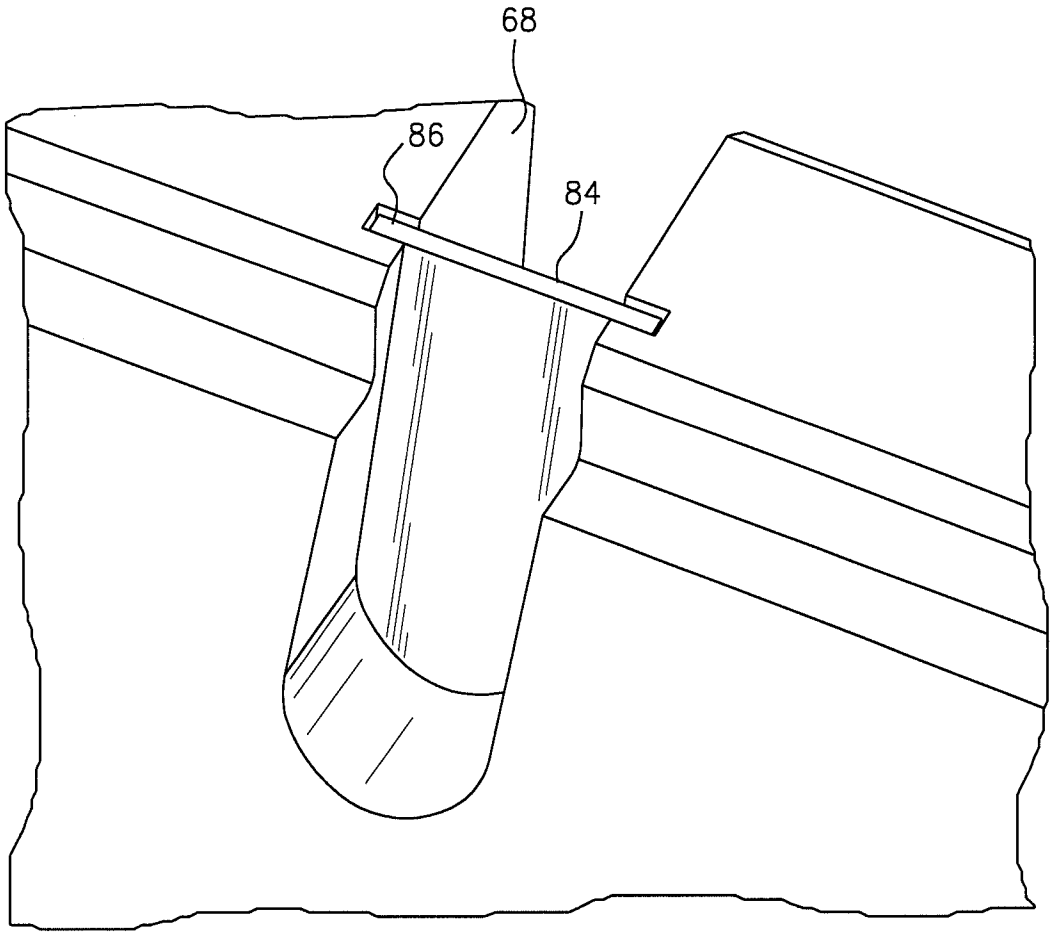
FIG. 9 is an expanded view looking forward at a scallop cut with a seal in the aft rail of the nozzle segment

To maintain the integrity of the seal surface 72, the scallop cut 82 is sealed by a feather seal 84 in accords with one disclosed non-limiting embodiment. The feather seal 84 is received within a slot 86 transverse to the scallop cut 68 to minimize or prevent loss of cooling air (FIG. 9). The W-seal 74, however, need not impinge upon the feather seal 84. That is, each scallop cut 68 forms a break in the full, annular ring while excessive loss of cooling air flow is prevented by the feather seal 84. It should be appreciated that although the LPT 46 is illustrated in the disclosed non-limiting embodiment, other engine sections where stress isolation slots must be sealed from leakage will also benefit here from.

Figure 10:
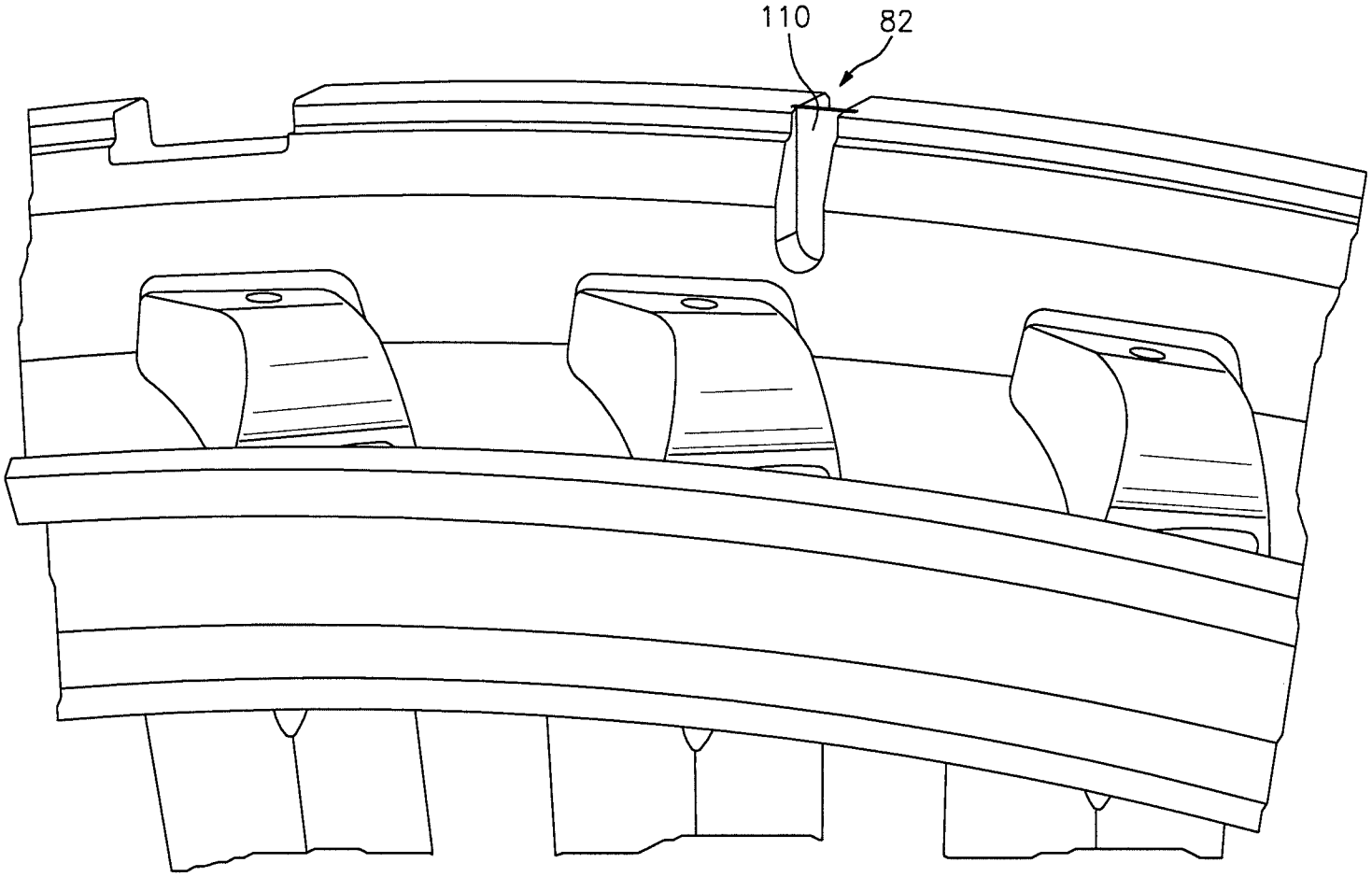
FIG. 10 is an expanded view looking aft toward an aft rail with a seal for a nozzle segment according to another disclosed non-limiting embodiment.
Figure 11:
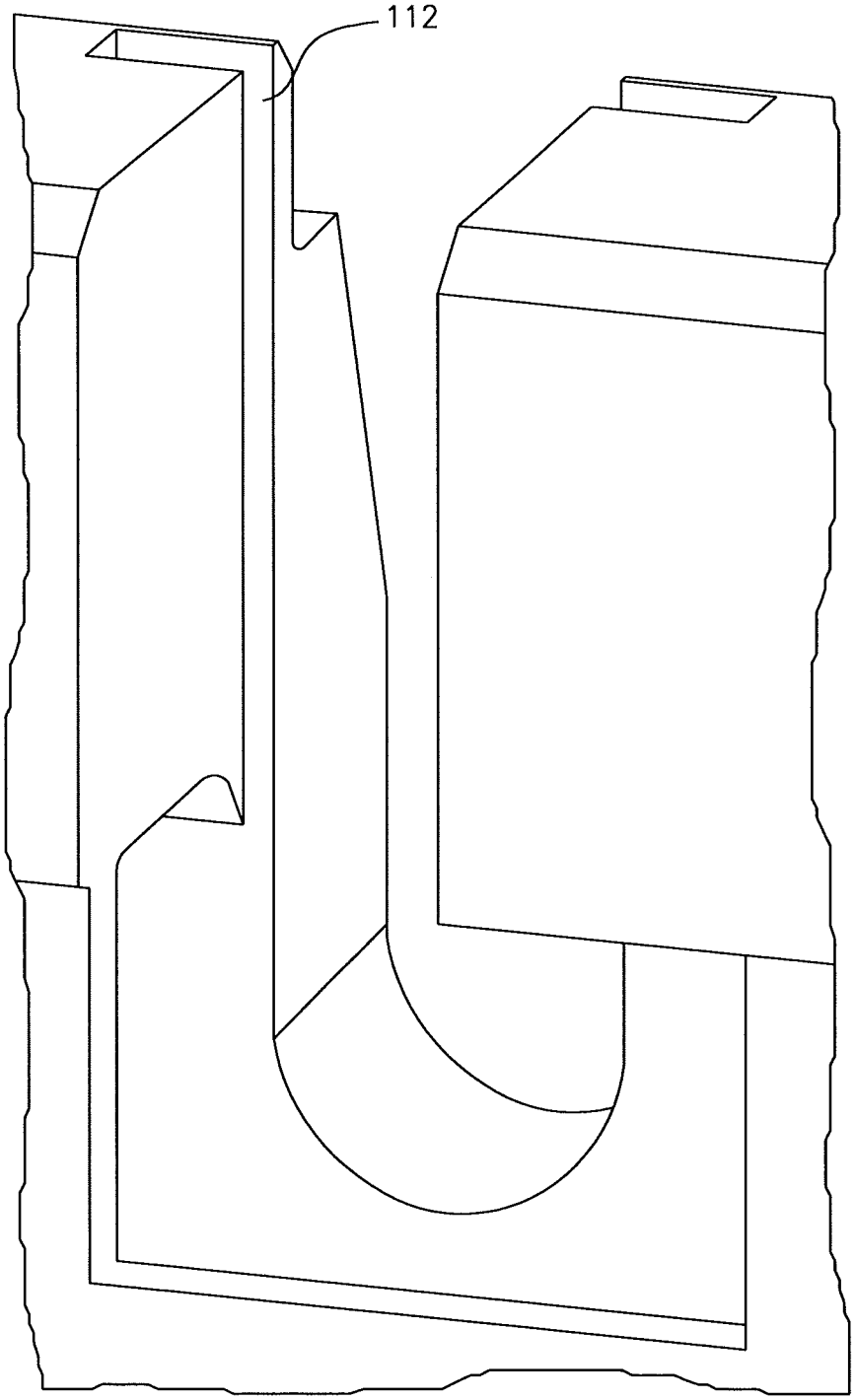
FIG. 11 is an expanded perspective view of the aft rail of the disclosed non-limiting embodiment of FIG. 10.
Figure 12:
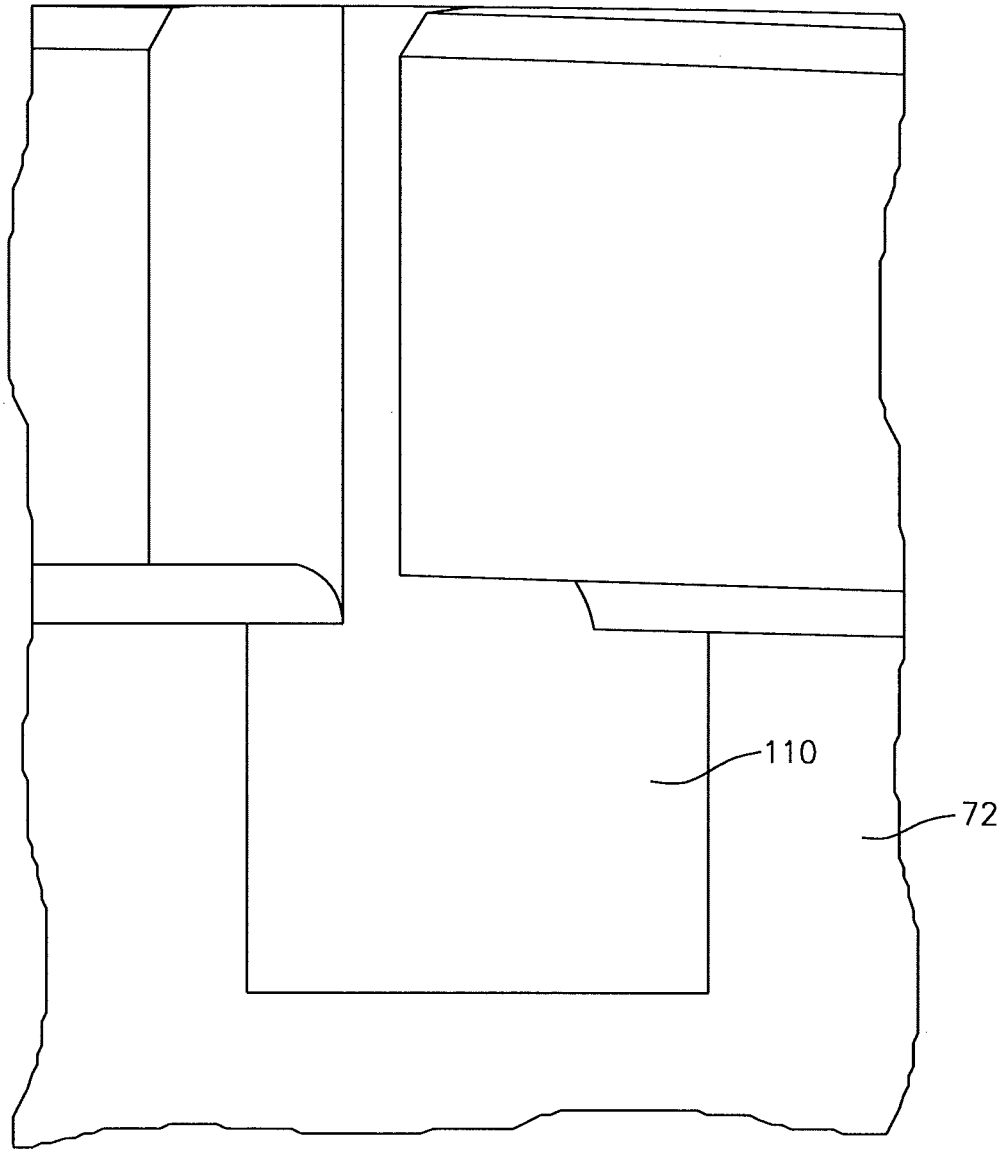
FIG. 12 is an expanded view looking forward at a scallop cut with a seal surface and a guillotine seal in the aft rail of the nozzle segment of the disclosed non-limiting embodiment of FIG. 10.
Figure 13:
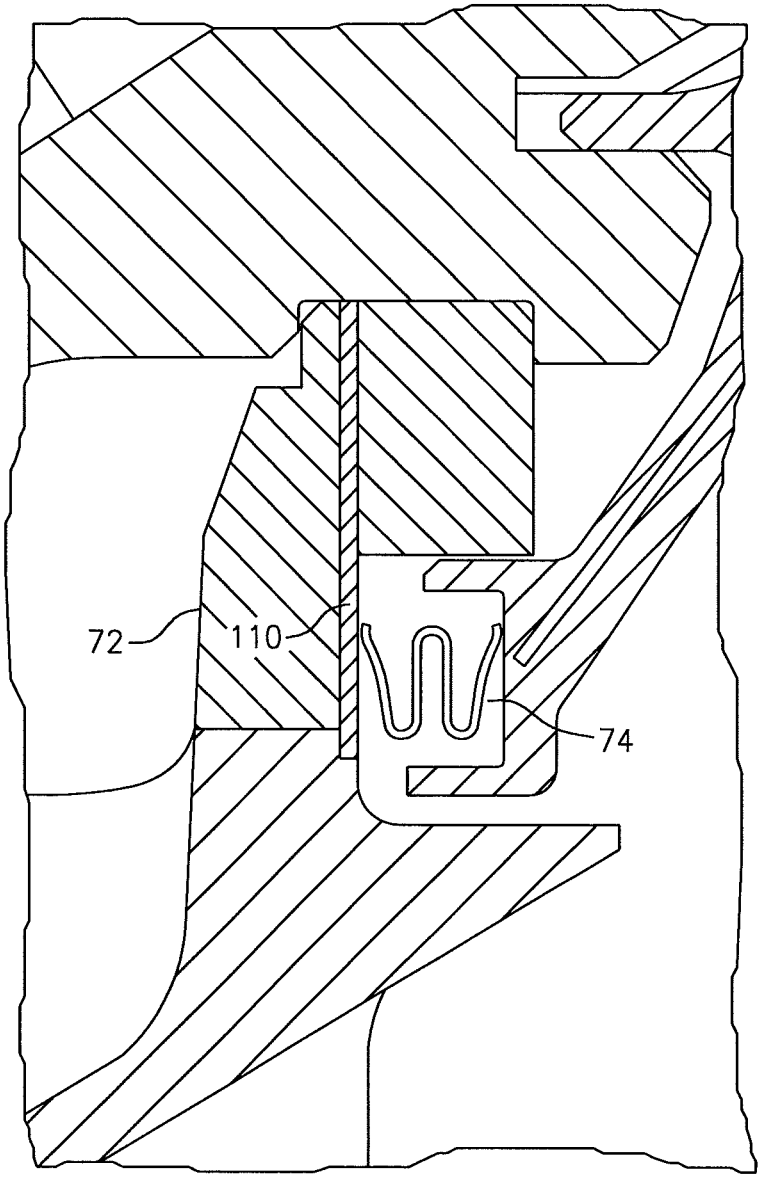
FIG. 13 is an expanded sectional view of a seal of the disclosed non-limiting embodiment of FIG. 10.
Figure 14:
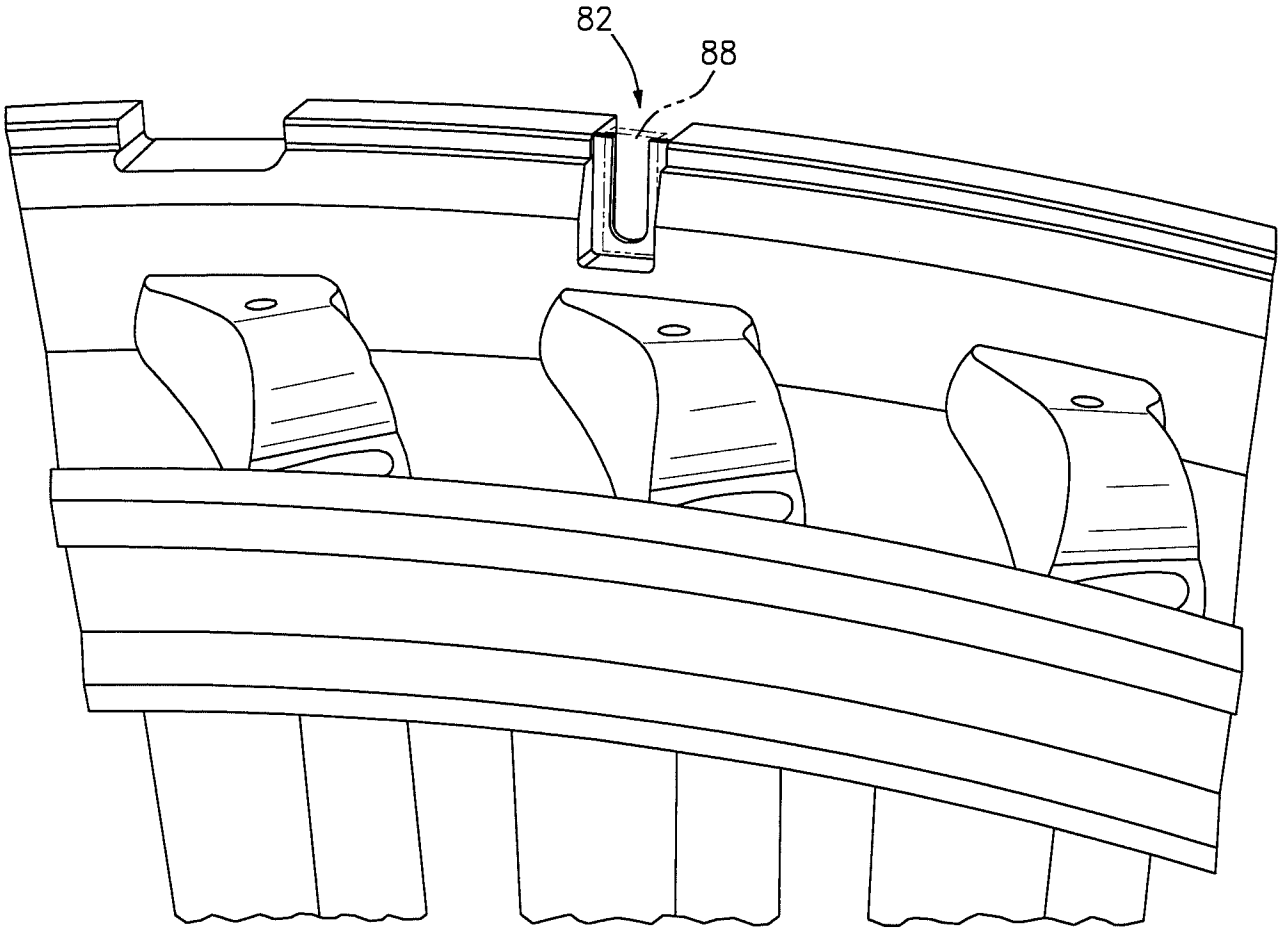
FIG. 14 is an expanded view looking aft toward an aft rail of a nozzle segment with a seal according to another disclosed non-limiting embodiment
Figure 15:
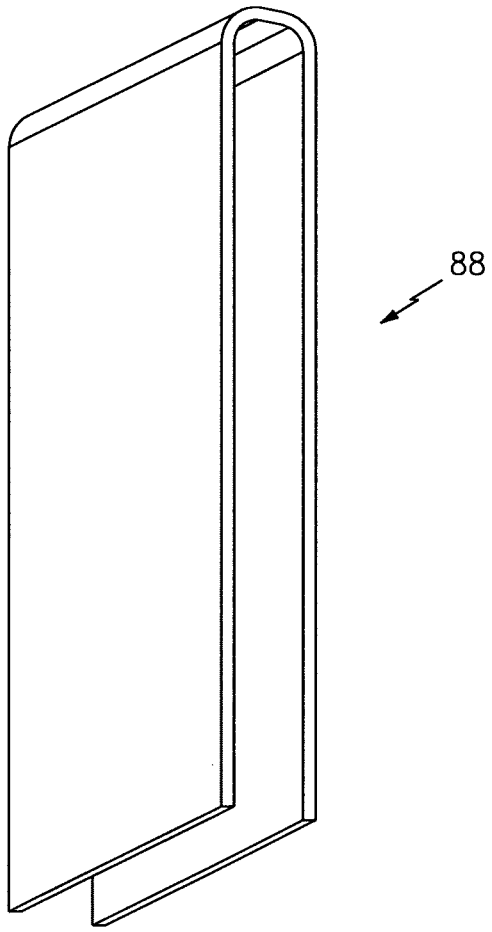
FIG. 15 is a perspective of a spring clip seal.
Figure 16:
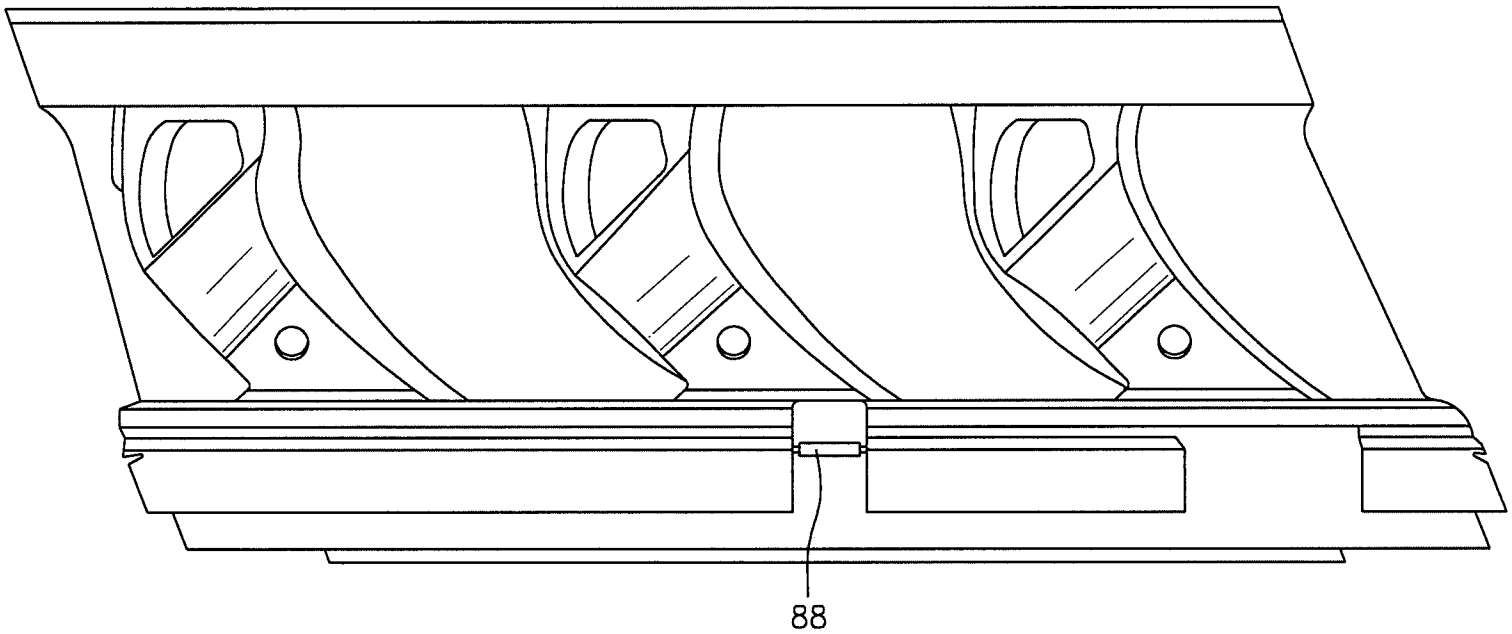
FIG. 16 is an expanded top view of the aft rail of the embodiment of FIG. 14.

With reference to FIG. 10, in accords with another disclosed non-limiting embodiment a guillotine seal 110 is received within a slot 112 (FIG. 11) to seal the scallop cut 82. The guillotine seal 110 extends for a depth into the seal surface 72 and is flush thereto (FIG. 12) so as to impinge an interface surface for a W-seal 74 (FIG. 13). The W-seal 74 seals airflow between a forward cavity 76 and an aft cavity 78. The W-seal 74 thereby seals airflow between a core airflow cavity 80 and the aft cavity 78 as the W-seal 74 also impinges the guillotine seal 110.

The guillotine seal 110 provides a fairly uniform seal surface 72 and is relatively thick, for example, about 0.05" (1.3 mm) that prevents bending from adverse pressure load into the about 0.075"×0.075" (1.9×1.9 mm) recess in the seal surface 72.

This disclosed non-limiting embodiment provides a somewhat more effective seal than the disclosed non-limiting embodiment of FIGS. 5-9 but may be somewhat more complicated to manufacture.

Figure 17:
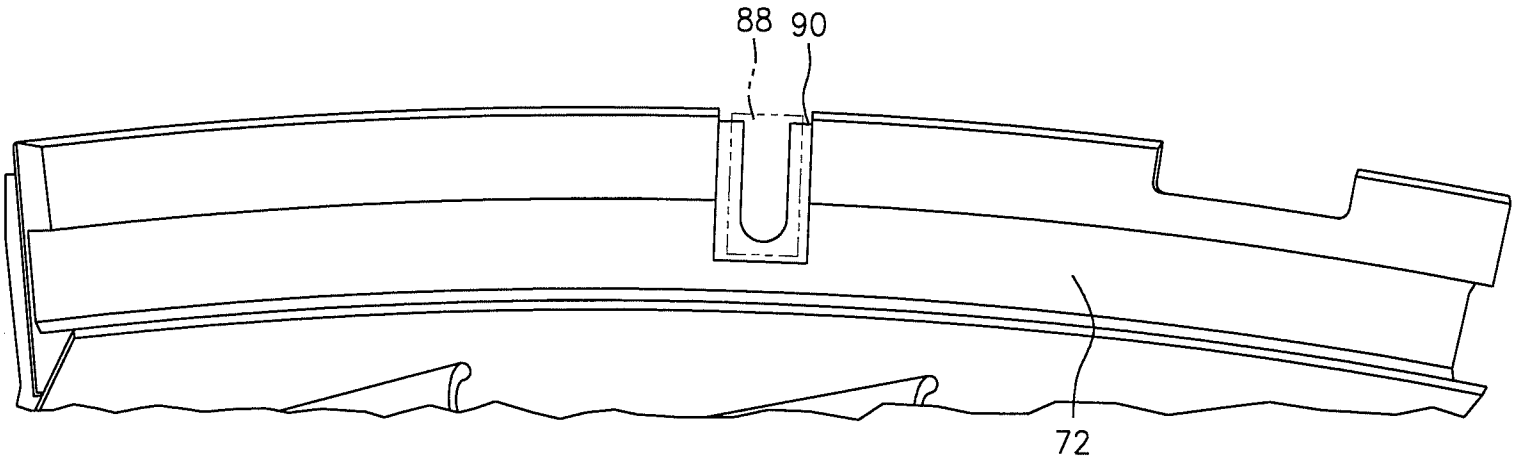
FIG. 17 is an expanded view looking forward at a scallop cut with a seal in the aft rail of the nozzle segment of the embodiment of FIG. 14.
Figure 18:
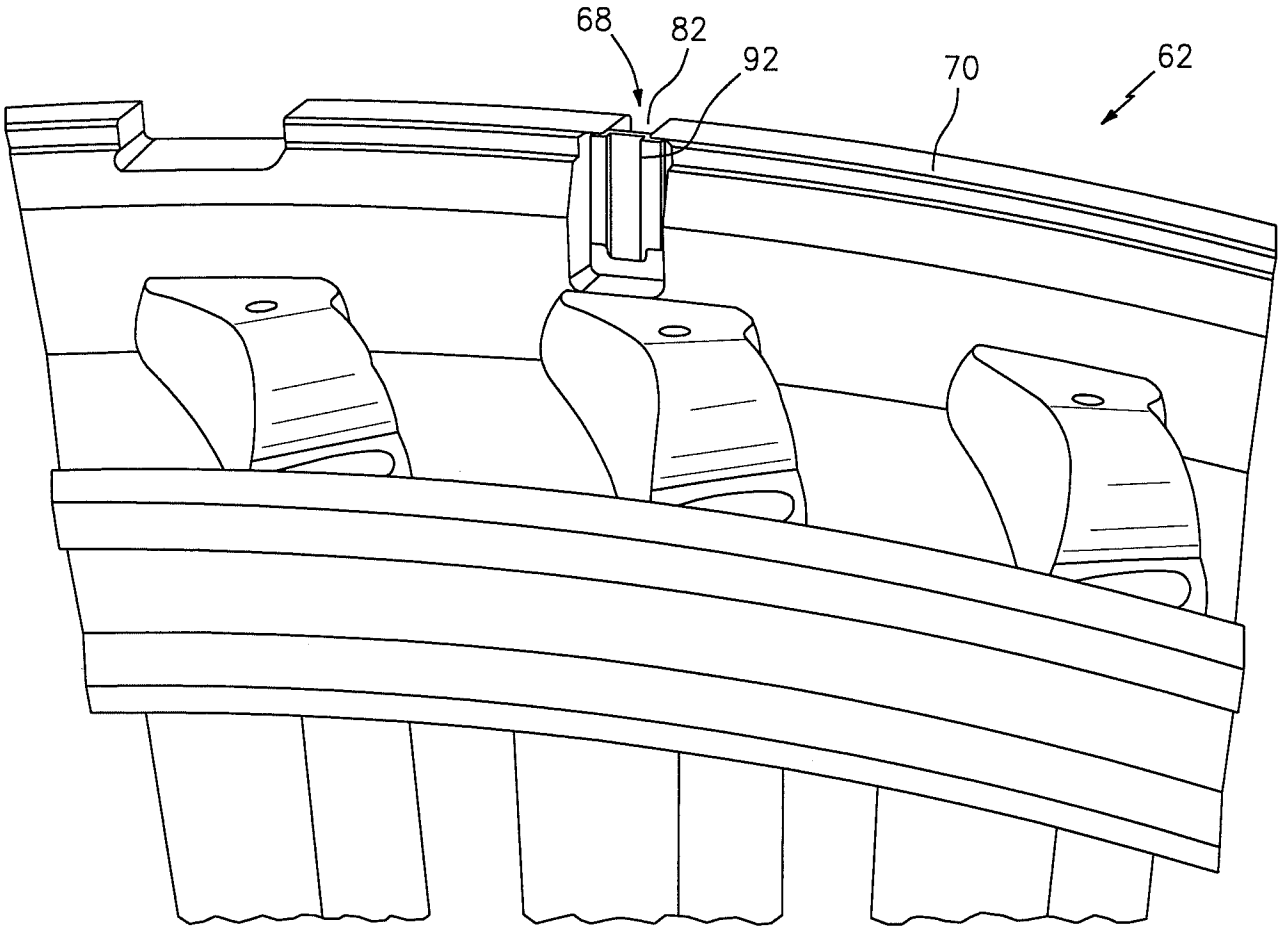
FIG. 18 is an expanded view looking aft toward an aft rail of a nozzle segment with a seal according to another disclosed non-limiting embodiment.

With reference to FIGS. 14-17, in accords with another disclosed non-limiting embodiment, a clip seal 88 (FIG. 15) seals the scallop cut 82. The clip seal 88 is received over a wall 90 (see FIGS. 16 and 17) within the scallop cut 68 (e.g., see FIGS. 5-7 and 9) to minimize or prevent excessive loss of cooling air. The clip seal 88 is generally flush with the seal surface 72 (FIG. 17).

Figure 19:
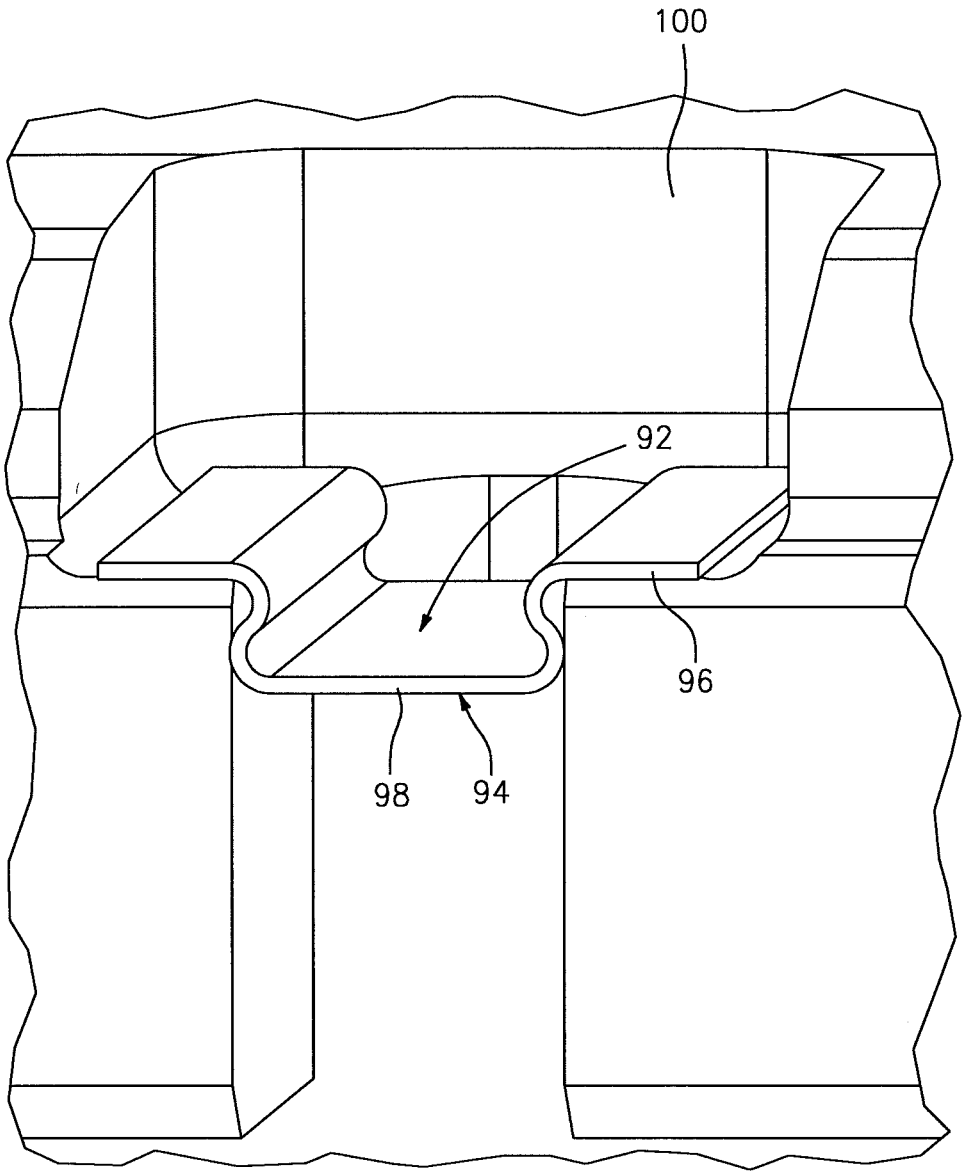
FIG. 19 is a perspective view of an omega seal.
Figure 20:
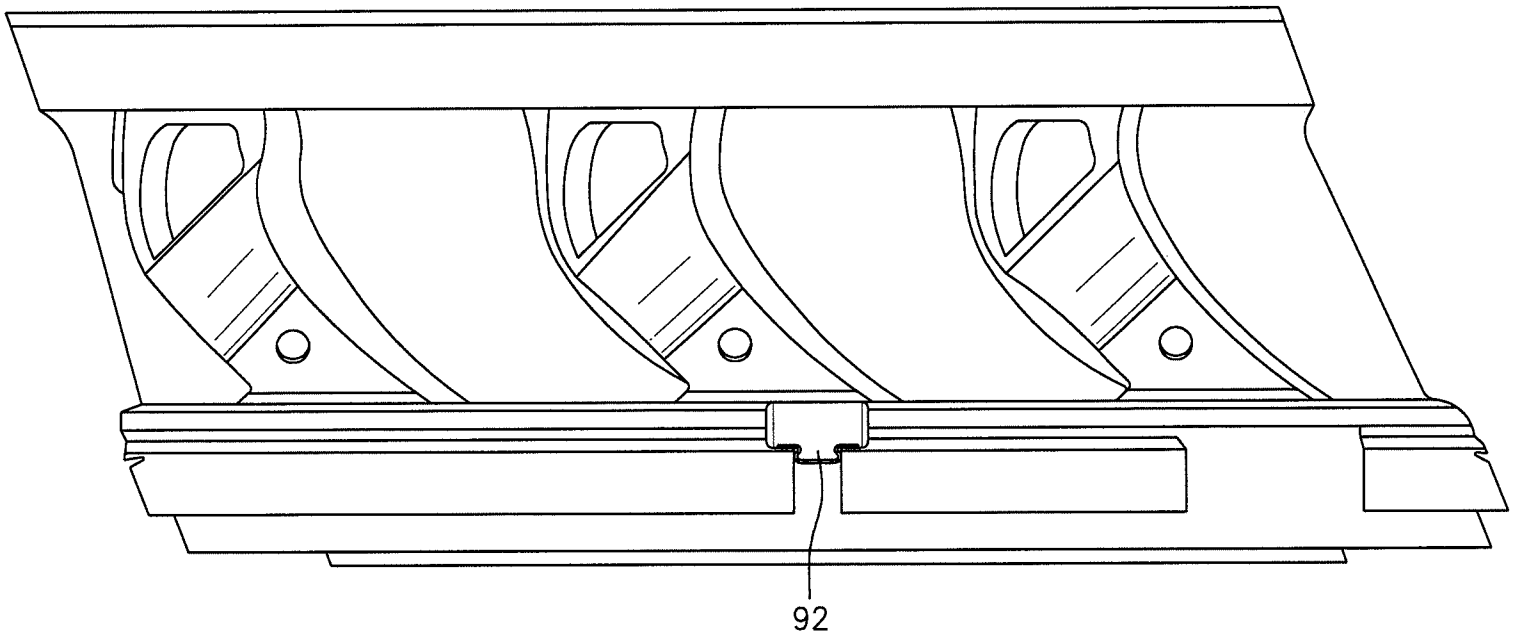
FIG. 20 is an expanded top view of the aft rail of the embodiment of FIG. 18.

With reference to FIGS. 18-21, in accords with another disclosed non-limiting embodiment, the scallop cut 82 is sealed by an omega-seal 92. The omega-seal 92 has a cross section similar to an omega symbol (Ω; FIG. 19).

Figure 21:
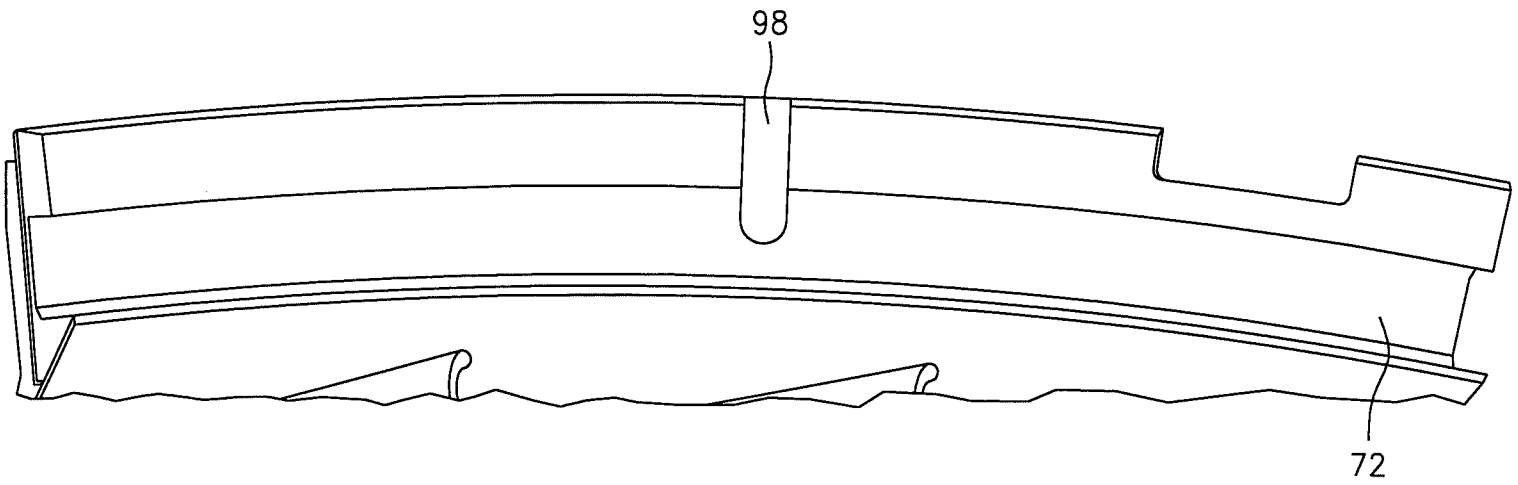
FIG. 21 is an expanded view looking forward at a scallop cut with a seal in the aft rail of the nozzle segment of the embodiment of FIG. 18.

With reference to FIG. 19, the omega-seal 92 generally has a central portion 94, located generally between legs 96. The central portion 94 is pressed into the scallop cut 82 (FIG. 20) such that a flat 98 of the central portion 94 is generally flush with the seal surface 72 (FIG. 21). The scallop cut 82 may include a wider portion 100 (see FIG. 19) to support the legs 96.

Figure 22:
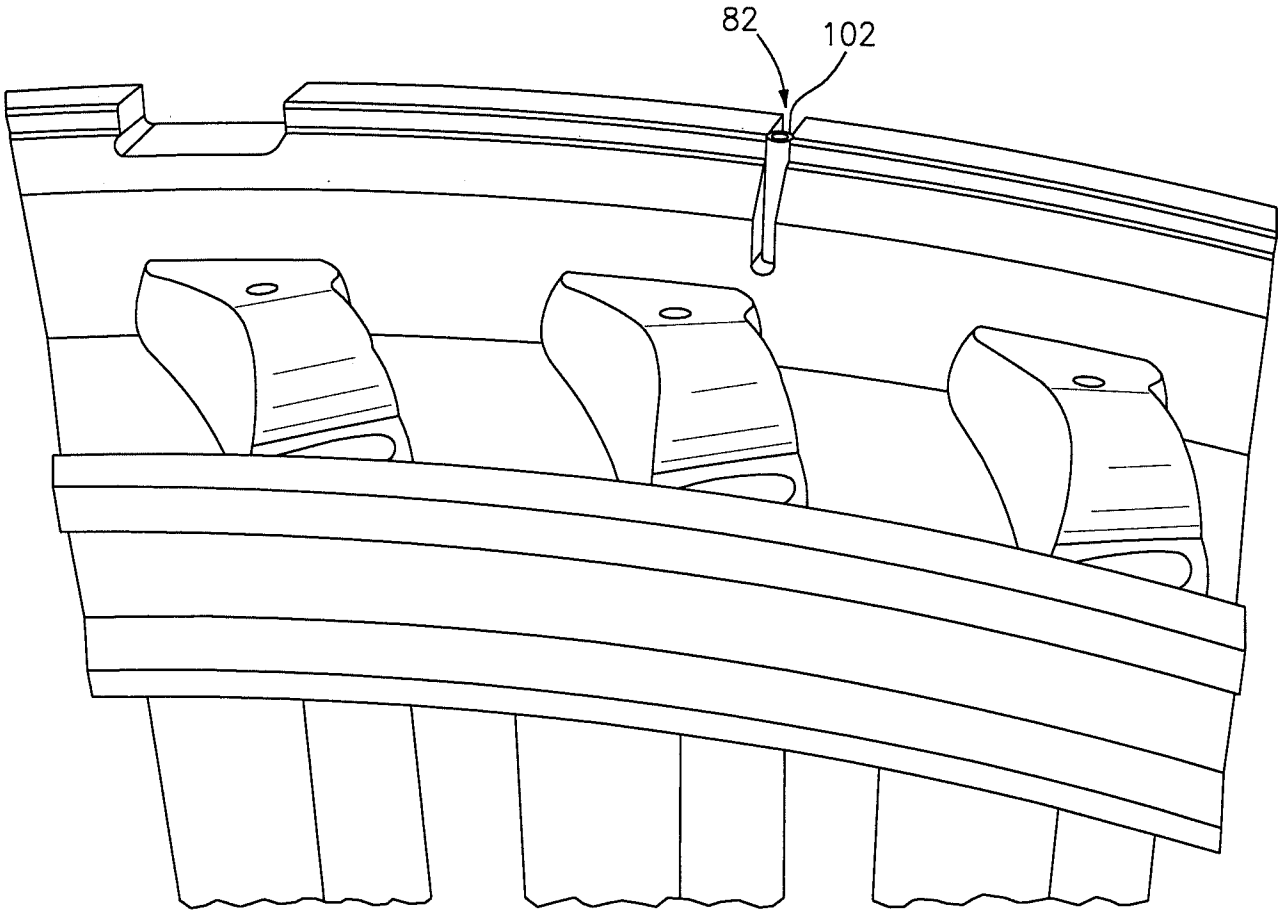
FIG. 22 is an expanded view looking aft toward an aft rail with a seal for a nozzle segment according to another disclosed non-limiting embodiment.
Figure 23:
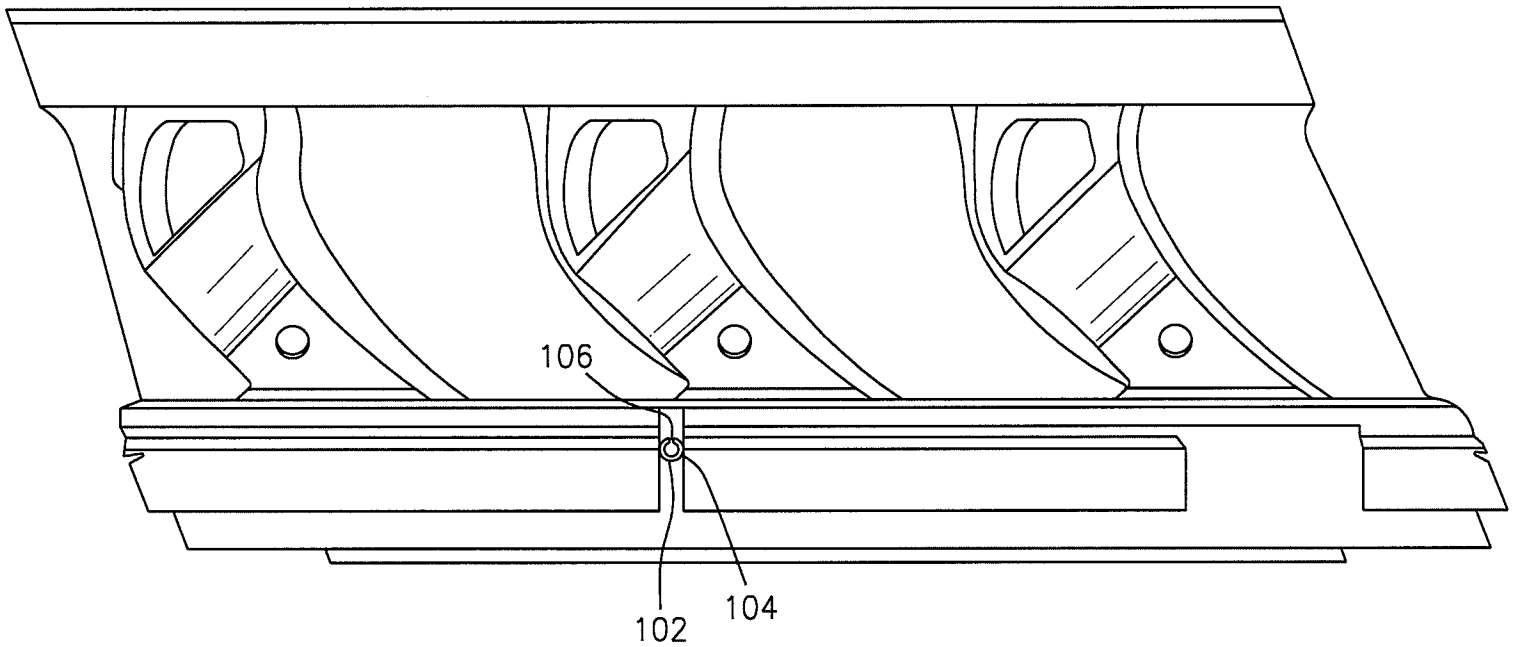
FIG. 23 is an expanded top view of the aft rail of the embodiment of FIG. 22.
Figure 24:
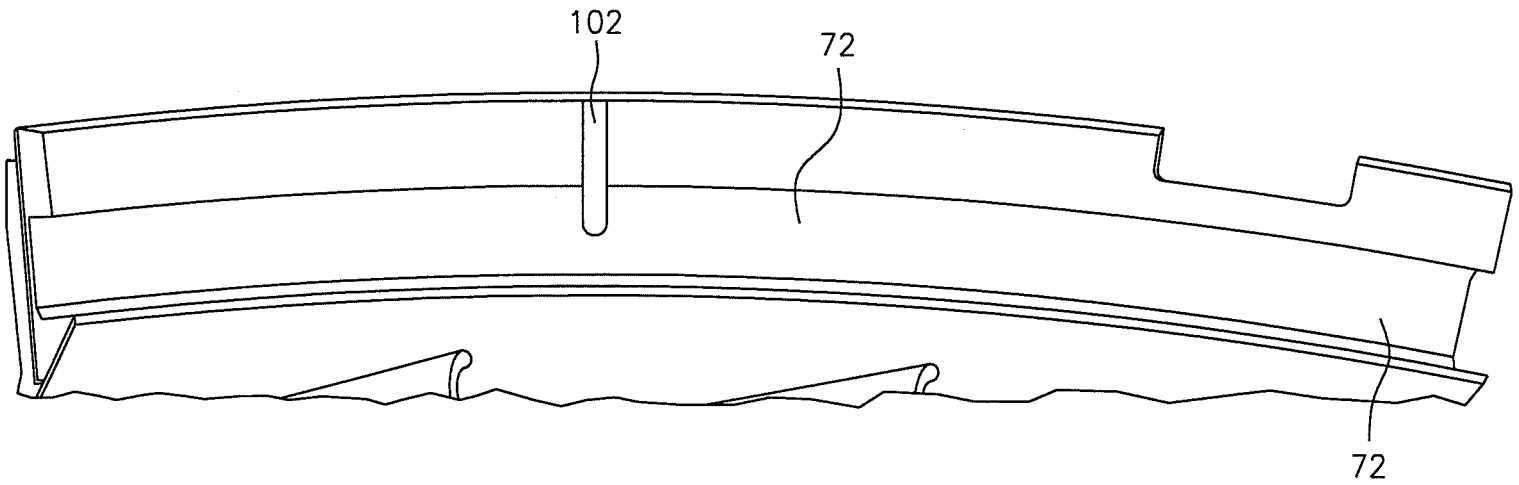
FIG. 24 is an expanded view looking forward at a scallop cut with a seal in the aft rail of the nozzle segment of the embodiment of FIG. 22.

With reference to FIGS. 22-24, in accords with another disclosed non-limiting embodiment, a spring pin 102 seals the scallop cut 82. The scallop cut 82 may include a semi-circular recess 104 (FIG. 23). That is, the semi-circular recess 104 may be a slightly smaller diameter than the spring pin 102 to provide an interference fit therefor.

With reference to FIG. 23, a break 106 in the spring pin 102 may be aligned inward such that air pressure opens the spring pin 102 to facilitate a seal within the scallop cut 82. It should be appreciated that various anti-rotation interfaces may additionally be utilized. That is, it may be desirable to prevent rotation of the spring pin 102. The spring pin 102 thereby readily responds to changes in scallop cut 82 geometry in response to thermal or physical loads as well as be generally flush with the seal surface 72 (FIG. 24).

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit here from.

The foregoing description is exemplary rather than defined by the limitations within Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A gas turbine engine comprising:

an annular nozzle with a multiple of scallop cuts, a first of the scallop cuts comprising a semi-circular portion and a rectangular portion adjacent the semi-circular portion, and the rectangular portion having a lateral width that is equal to a diameter of the semi-circular portion; and a plurality of seals respectively sealing said multiple of scallop cuts, a first of the seals comprising of a sheet of material that plugs and extends laterally across the semi-circular portion and the rectangular portion.

2. The gas turbine engine as recited in claim 1, wherein said multiple of scallop cuts are located in an arcuate outer vane platform segment.

3. The gas turbine engine as recited in claim 1, wherein said multiple of scallop cuts are located in an aft vane rail hook.

4. The gas turbine engine as recited in claim 1, wherein said annular nozzle includes a multiple of airfoils.

5. The gas turbine engine as recited in claim 1, wherein each seal is a feather seal.

6. The gas turbine engine as recited in claim 1, wherein each seal is adjacent a W-seal surface.

7. The gas turbine engine as recited in claim 1, wherein each seal is a clip seal.

* * * * *